US007453484B2

(12) United States Patent
Hori

(10) Patent No.: US 7,453,484 B2
(45) Date of Patent: Nov. 18, 2008

(54) IMAGE FORMING APPARATUS

(75) Inventor: Kazuto Hori, Daito (JP)

(73) Assignee: Funai Electric Co., Ltd., Daito-shi (JP)

( * ) Notice: Subject to any disclaimer, the term of this patent is extended or adjusted under 35 U.S.C. 154(b) by 162 days.

(21) Appl. No.: 11/262,950

(22) Filed: Nov. 1, 2005

(65) Prior Publication Data

US 2006/0093387 A1 May 4, 2006

(30) Foreign Application Priority Data

Nov. 1, 2004 (JP) ..... 2004-318532

(51) Int. Cl.
*B41J 2/435* (2006.01)

(52) U.S. Cl. ..... 347/236; 347/246

(58) Field of Classification Search ..... 347/255, 347/246–247, 236–237
See application file for complete search history.

(56) References Cited

U.S. PATENT DOCUMENTS 4,935,615 A * 6/1990 Yoshida Eiichi et al. .... 250/205
5,043,745 A * 8/1991 Inoue et al. ..... 347/246
6,563,848 B1 * 5/2003 Iwazaki ..... 372/38.02
6,785,484 B2 * 8/2004 Nishiyama ..... 399/68
7,045,771 B2 * 5/2006 Ishikawa et al. ..... 250/234
2003/0133001 A1 * 7/2003 Horie et al. ..... 347/132

FOREIGN PATENT DOCUMENTS

JP 04163566 A * 6/1992
JP 04-291377 A 10/1992
JP 06-175450 A 6/1994
JP 08290608 A * 11/1996

* cited by examiner

*Primary Examiner*—Hai C Pham
(74) *Attorney, Agent, or Firm*—Crowell & Moring LLP

(57) ABSTRACT

In a laser beam printer, even when an inexpensive CPU having low throughput capacity is used, stable power can be obtained by following a sudden change in temperature of a laser chip. A control unit sets a scanning cycle for performing the automatic power control based on ambient temperature of a photoconductive drum and the number of continuously-printed sheets. Then, the control unit output a horizontal synchronizing signal to a laser driving circuit and causes a laser scan unit to output a scanning laser beam. Substantially, when scanning corresponds the scanning cycle, the automatic power control is performed based on an output signal of a photodiode. When scanning does not correspond to the scanning cycle, a horizontal synchronizing signal of the next line is output. Whereby, the scanning cycle for performing the automatic power control according to a change in temperature of the laser chip, thereby reducing loads applied to the control unit.

3 Claims, 6 Drawing Sheets

IMAGE FORMING APPARATUS

BACKGROUND OF THE INVENTION

1. Field of the Invention

The present invention relates to relates to an image forming apparatus equipped with a laser scan unit that irradiates and scans a laser beam on a surface of a photoconductive drum to form a latent image.

2. Description of the Related Art

A laser device used for a laser scan unit of an image forming apparatus is provided with a laser chip for emitting a laser beam and a photodiode for receiving a part of the laser beam for the monitoring of the output power of the laser chip. The photodiode converts the received laser beam into an electric signal and feeds back the electric signal to a control unit of the image forming apparatus. The control unit receiving the fed back electric signal outputs a predetermined current control signal to a laser driving circuit based on the electric signal. In this manner, an automatic power control of the laser chip is performed by the control unit.

Output power characteristics of the laser chip depend on the temperature of the laser device, etc. Thus, in executing printing operation, laser power needs to be optimally controlled by performing the above-mentioned automatic power control according to a change in temperature of the laser device due to heat generation caused by light emission of the laser chip. In a conventional image forming apparatus, the automatic power control is performed at every scanning so that the laser power can be properly controlled even at the beginning of printing when an increase in temperature of the laser device is remarkable, thereby applying excessive loads on the control unit. Especially under the situation where an improvement in processing speed of the image forming apparatus is required, time necessary for one scanning needs to be shortened. As a result, the loads applied on the control unit have increased more and more.

During printing, the control unit has tasks such as processing of an image signal and convey and control of recording paper sheet. With recent demand for high resolution, the number of image signals to be processed has been drastically increased and convey and control with a higher degree of accuracy has been demanded. Thus, to achieve both of these tasks and the automatic power control without failure, it is necessary to use a CPU having appropriate throughput capacity as the control unit. The CPU having high throughput capacity is very expensive, which contributes to a substantial raise in manufacturing costs of the image forming apparatus. Thus, such CPU is not suitable for, in particular, the image forming apparatus for the consumer public requiring lower price.

Besides, Japanese Laid-Open Patent Publication No. 4-291377 discloses a laser beam printer capable of making fine adjustments to the output power of the laser device so as to prevent variation in resolution due to variation in sensitivity characteristics of a photoconductive drum or the like. Japanese Laid-Open Patent Publication No. 6-175450 discloses a copying machine capable of preventing variation in density due to a minute variation of currents or noise in the machine.

SUMMARY OF THE INVENTION

To solve the above-mentioned problem, an object of the present invention is to provide an image forming apparatus capable of controlling a driving current so as to follow a rapid change in temperature of the laser device to obtain stable laser power even when an inexpensive CPU having low throughput capacity is used.

An image forming apparatus in accordance with an aspect of the present invention has a photoconductive drum on which a photoconductor is applied, a charging unit for uniformly charging a surface of the photoconductive drum, an exposing unit for irradiating and scanning a laser beam on the surface of the conductor to form a latent image, a developing unit for applying toner to a portion of the photoconductor on which the latent image is formed to form a toner image, a transfer unit disposed to face the surface of the photoconductive drum at a predetermined transfer position downstream side of the developing unit in the rotation direction of the photoconductive drum for transferring the toner image formed on the surface of the photoconductive drum on a recording paper sheet, a fixing unit for applying predetermined heat and pressure to the recording paper sheet on which the toner image is transferred to fix the toner image on the recording paper sheet, a control unit for controlling each of the units and a temperature detecting unit for detecting ambient temperature of the photoconductive drum.

The exposing unit has a laser device for emitting a laser beam, a light receiving device for receiving a part of the laser beam emitted from the laser device, converting the laser beam into an electric signal and outputting the electric signal to the control unit for the monitoring an output power of the laser device, and a laser driving circuit for driving the laser device based on a current control signal output from the control unit.

Before irradiating the laser beam for one scanning to the photoconductive drum, the control unit performs an automatic power control for controlling the output power of the laser device by gradually increasing the level of the current control signal, determining an optimum driving current for the laser device based on the output value of the light-receiving device at that time and controlling the laser driving circuit. When printing is continuously performed within predetermined time, the number of continuously-printed sheets are calculated and stored, and a scanning cycle for performing the automatic power control of the laser device is set based on the stored number of the continuously-printed sheets and the temperature detected by the temperature detecting unit.

According to such configuration, the control unit sets the scanning cycle for performing the automatic power control based on the number of the continuously-printed sheets within predetermined time and the ambient temperature of the photoconductive drum and performs the automatic power control only when scanning of the laser beam irradiated by the exposing unit corresponds to the scanning cycle for performing the automatic power control, so that loads applied to the control unit can be reduced by decreasing the frequency for performing the automatic power control. Thus, an inexpensive CPU having low throughput capacity can be used for the control unit, and thereby reducing manufacturing costs of the image forming apparatus.

DETAILED DESCRIPTION OF THE EMBODIMENTS

Figure 1:
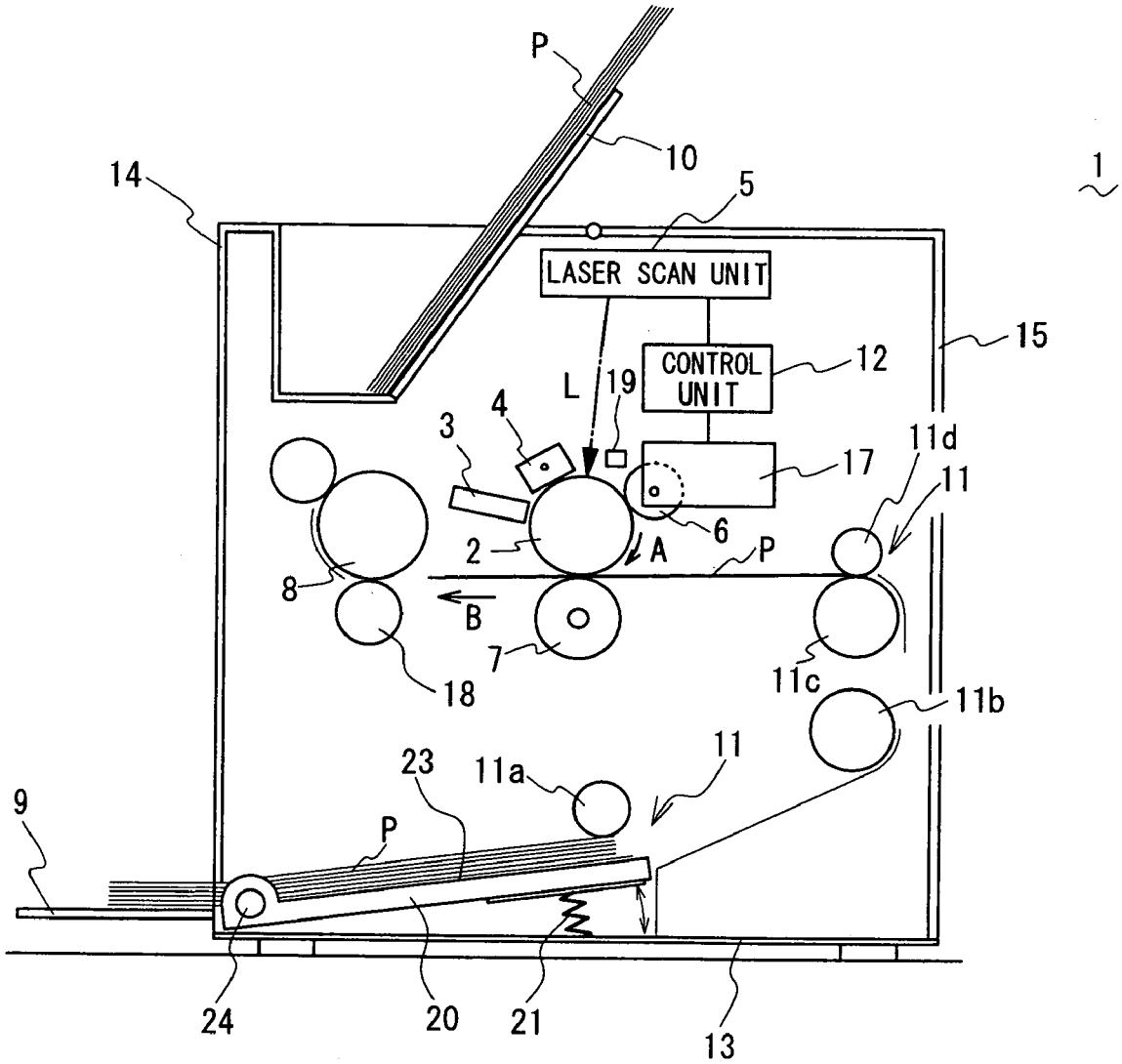
FIG. 1 is a view showing a configuration of a laser beam printer in accordance with an embodiment of the present invention.

A laser beam printer in accordance with an embodiment for carrying out the present invention will be described with reference to drawings. FIG. 1 shows an example of a laser beam printer 1. The laser beam printer 1 is comprised of a photoconductive drum 2 on which a photoconductor is applied, a cleaner 3, an charger (charging unit) 4, a laser scan unit (exposing unit) 5, a developing brush (developing unit) 6 and a transfer roller (transfer unit) 8, which are disposed around the photoconductive drum 2 from the upstream side toward the downstream side of a rotation direction A in this order, a fixing roller (fixing unit) 8 disposed on the downstream side of a conveying direction B of a recording paper sheet P with respect to the transfer roller 7, a paper sheet feed tray 9 on which the recording paper sheets P are loaded, a paper exit tray 10 for accumulating the printed recording paper sheets P thereon, a recording paper sheet conveying mechanism (conveying unit) 11 for conveying the recording paper sheet P and a control unit 12 for controlling each unit of the apparatus. Each of the above elements is attached to a metal frame 13 disposed on the bottom of the laser beam printer 1 or the like. The metal frame 13 is equipped with a housing 14 for covering the above elements and forming an exterior package of the laser beam printer 1. A door member 15, through which the recording paper sheet P jammed in the recording paper sheet conveying mechanism 11 is removed or a toner cartridge 17 described later is exchanged, is formed on the upper portion of the housing 14 so as to be freely opened and closed.

A temperature sensor 19 for detecting ambient temperature of the photoconductive drum 2 is provided in the vicinity of the photoconductive drum 2. The temperature detected by the temperature sensor 19 is fed back to control unit 12 on the occasion of exposure, development and transfer. The cleaner 3 removes toner and paper dusts adhered to a surface of the photoconductive drum 2 in the previous operation (one rotation before) so as to clean the surface of the photoconductive drum 2. The charger 4 uniformly charges the surface of the photoconductive drum 2 cleaned by the cleaner 3. The laser scan unit 5 irradiates a laser beam L on the surface of the photoconductive drum 2 charged by the charger 4 during scanning to form a latent image. Electric power is supplied to the laser scan unit 5 by a power supply device (not shown) so that a light-emitting voltage for light emission of the laser device is applied. The developing brush 6 is attached to the toner cartridge 17 that stores toner therein, and applies the toner to a portion of the photoconductive drum 2 on which the latent image is formed to form a toner image. The transfer roller 7 is provided to face the surface of the photoconductive drum 2, and charges the surface of the recording paper sheet P while pressing the recording paper sheet P to the surface of photoconductive drum 2 so as to transfer the toner image formed on the surface of the photoconductive drum 2 on the recording paper sheet P. A transfer voltage for charging the surface of the recording paper sheet P is applied to the transfer roller 7 from the power supply device. The fixing roller 8 nips the recording paper sheet P with a roller 18 disposed at a position facing thereto, and applies heat and pressure to the recording paper sheet P to fix the toner. Heat for fixing the toner is supplied from a heater (for example, halogen lamp, etc.) built in the fixing roller 8. A fixing voltage generated by the power supply device is applied to the heater.

The recording paper sheet conveying mechanism 11 has a pickup roller 11*a*, conveying rollers 11*b*, 11*c* and 11*d*, a paper sheet loading plate 20 disposed in the vicinity of the paper sheet feed tray 9 for pressing the loaded recording paper sheet P against the pickup roller 11*a*, and a coil spring 21 for pressing the paper sheet loading plate 20 to the side of the pickup roller 11*a*.

A recording paper sheet mounting plane 23 on which the recording paper sheets P are loaded is consecutively formed with the paper sheet feed tray 9 and the paper sheet loading board 20. By inserting multiple recording paper sheets P in the stacked state from the side of the paper sheet feed tray 9 by the user, the recording paper sheets P are mounted on the recording paper sheet mounting plane 23.

The pickup roller 11*a* disposed for facing the recording paper sheet mounting plane 23 sends a top sheet of the recording paper sheets P mounted on the recording paper sheet mounting plane 23 to the conveying roller 11*b*. The conveying roller 11*b* sends the recording paper sheet P sent by the pickup roller 11*a* to the conveying roller 11*c*. The conveying rollers 11*c* and 11*d* disposed for facing each other between the conveying roller 11*b* and the transfer roller 7 convey the recording paper sheet P sent by the conveying roller 11*b* to a transfer position.

Figure 2:
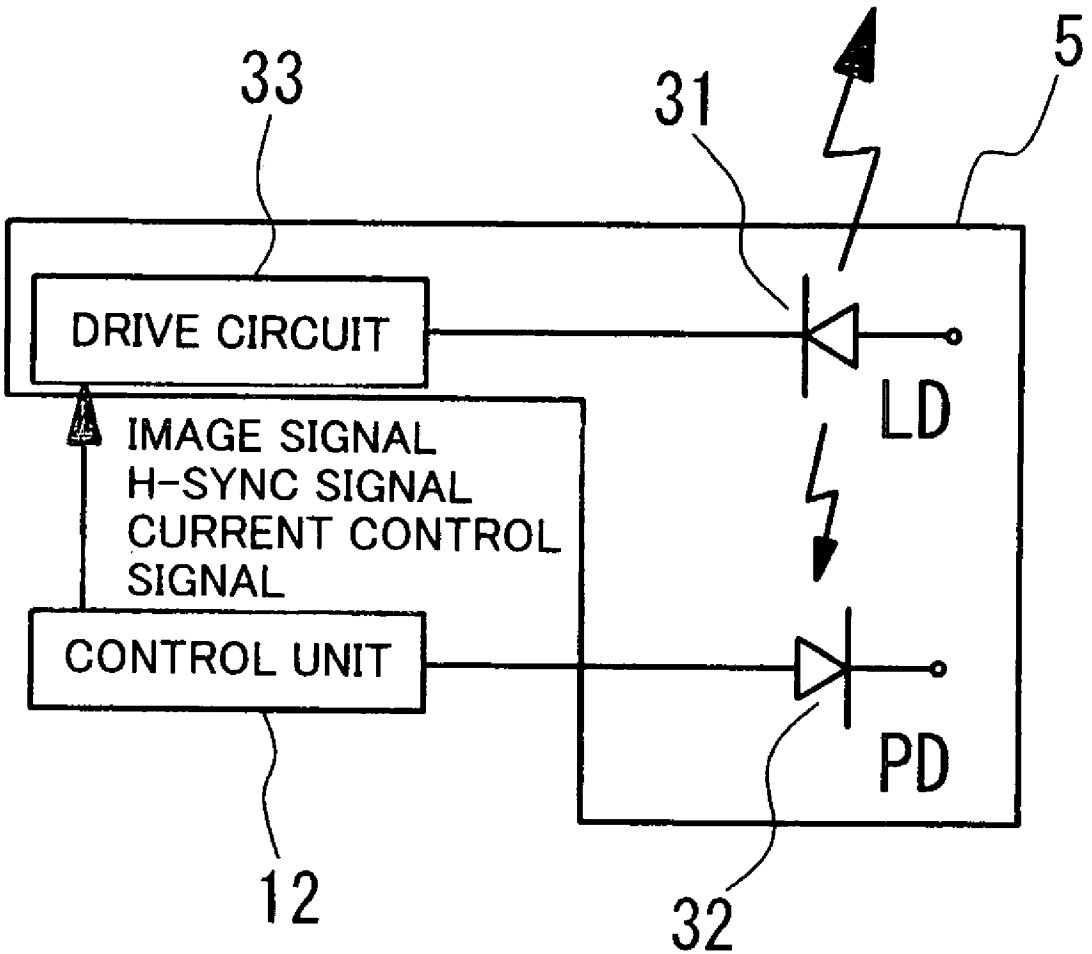
FIG. 2 is a block diagram showing a partial configuration of a laser scan unit used in the laser beam printer.

FIG. 2 shows an electric configuration of the laser scan unit 5. The laser scan unit 5 has a laser chip (light-emitting device) 31 for emitting a laser beam, a photodiode (light-receiving device) 32 for monitoring an output power of the laser chip 31 and a laser driving circuit 33 for driving the laser chip 31. The photodiode 32 receives a part of the laser beam emitted from the laser chip 31, converts the beam into an electric signal and outputs the electric signal to the control unit 12. The laser drive circuit 33 drives the laser chip 31 on the basis on an image signal, a horizontal synchronizing signal and a current control signal that are output from control unit 12. The laser chip 31 and the photodiode 32 are accommodated in one package of a semiconductor laser (laser device). The laser driving circuit 33 is formed on a circuit board on which the semiconductor laser is mounted.

As mentioned above, output power characteristics of the laser chip 31 depends on the temperature of the laser chip 31 and the like. However, since the temperature of the laser chip 31 varies due to heat generation caused by light emission of the laser chip 31, the laser power needs to be optimally controlled by performing the above-mentioned automatic power control in printing.

Figure 3:
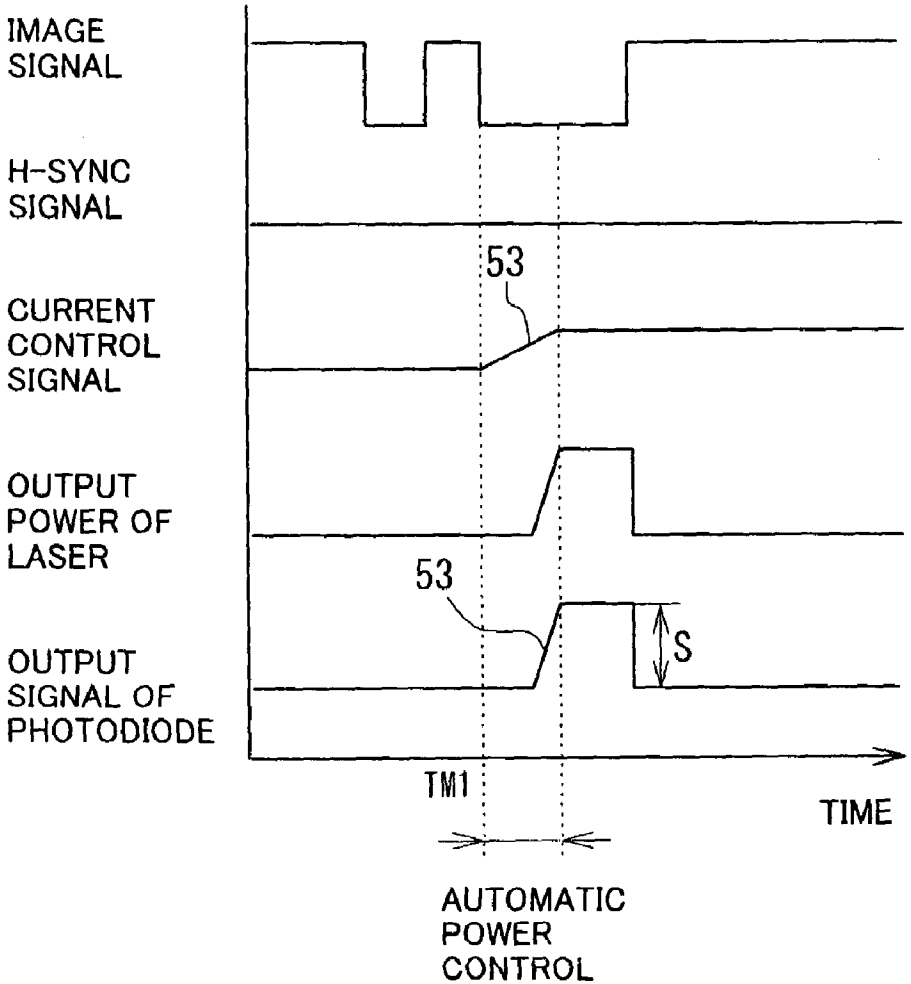
FIG. 3 is a time chart showing an image signal, a horizontal synchronizing signal and a current control signal that are output from a control unit, an output power of a laser chip and an output signal of a photodiode in performing an automatic power control at the beginning of printing.

FIG. 3 shows an image signal, a horizontal synchronizing signal and a current control signal which are output from the control unit 12 to the laser driving circuit 33, an output power of the laser chip (light-emitting power) 31 and a signal output from the photodiode 32 to the control unit 12 in performing the automatic power control at the beginning of printing. The automatic power control at the beginning of printing is performed according to the following procedure, for example. That is, at the beginning of printing, the control unit 12 gradually increases the level of the current control signal 53 output to the laser drive circuit 33 from a predetermined low level at a time TM1. In this connection, the output power of the laser chip 31 is increased gradually and an output signal 55 corresponding to the output power of the laser chip 31 is detected from the photodiode 32. Then, the control unit 12 stores a level of the current control signal 53 at the time when the output signal 55 shows a predetermined reference value S. After that, the control unit 12 controls the laser drive circuit 33 so as to optimize laser power based on the level of the stored current control signal 53.

Figure 4:
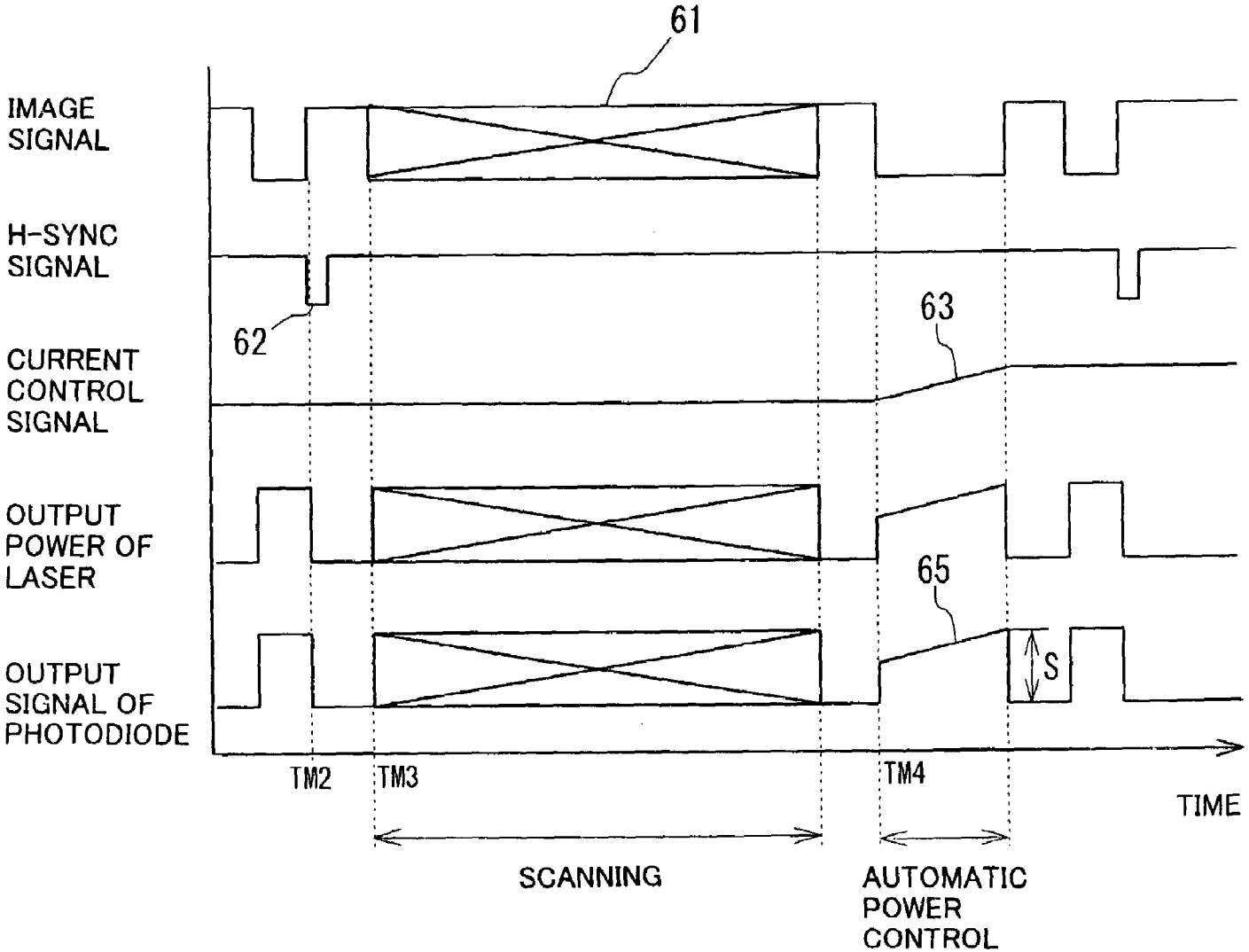
FIG. 4 is a time chart showing an image signal, a horizontal synchronizing signal, a current control signal, an output power of a laser chip and an output signal of a photodiode from the beginning of scanning of one line to the completion of the automatic power control.

After completing the automatic power control shown in FIG. 3, a laser beam scanned on the photoconductive drum 2 to form a latent image. FIG. 4 shows an image signal, a horizontal synchronizing signal and a current control signal which are output from the control unit 12 to the laser driving circuit 33, an output power of the laser chip (light-emitting power) 31 and a signal output from the photodiode 32 to the control unit 12 in performing scanning of one line. In printing on the recording paper sheet P, scanning of the laser beam is performed number of times according to the size of the recording paper sheet P and the resolution in the vertical scanning direction, and FIG. 4 shows one scanning operation.

First, a horizontal synchronization signal 62 of low level is output from the control unit 12 to the laser drive circuit 33 at a time TM2. The horizontal synchronization signal 62 is a signal to inform a timing serving as a reference to output an image signal 61 from the control unit 12 to the laser driving circuit 33 and to start the scanning after passing a predetermined time. In other words, at a time TM3 when a predetermined time has passed from the time TM2, the image signal 61 is output from the control unit 12 to the laser driving circuit 33 and the scanning is started. Then, the laser driving circuit 33 drives the laser chip 31 according to the received image signal 61 and the laser beam corresponding to the image signal 61 is emitted from the laser chip 31. The laser beam emitted from the laser chip 31 is reflected by a polygon mirror (not shown) so as to scan and to be irradiated on the photoconductive drum 2.

FIG. 4 shows a procedure of performing the automatic power control immediately after scanning of one line. However, in this embodiment, the automatic power control is not performed on every occasion following scanning of one line. The scanning cycle for performing the automatic power control is determined according to the ambient temperature of the photoconductive drum 2 detected by the temperature sensor 19 and the like, and for example, when the ambient temperature of the photoconductive drum 2 is sufficiently high, the automatic power control is performed at each time after performing the scanning of a plurality of lines.

On the other hand, for example, when the ambient temperature of the photoconductive drum 2 is not sufficiently high at the beginning of power-on of the laser beam printer 1, the automatic power control is performed at every scanning of one line. In the case where the automatic power control is performed at every scanning of one line in this way, the procedure shown in FIG. 4 is employed. Specifically, when scanning of one line is completed, the control unit 12 gradually increases the level of the current control signal 63 output to the laser driving circuit 33 from a predetermined low level at a time TM4. Following to this operation, the output power of the laser chip 31 is increased gradually and the output signal 65 corresponding to the output power of the laser chip 31 is detected from the photodiode 32. Then, the control unit 12 stores the level of the current control signal 63 at the time when the output signal 65 shows the predetermined reference value S. After that, the control unit 12 controls the laser drive circuit 33 so as to optimize laser power based on the level of the stored current control signal 63. Since FIG. 4 shows each signal about scanning of one line, scanning of the number of lines depending on the size of the recording paper sheet P and the resolution in the vertical scanning direction is performed repeatedly.

By the way, although the laser chip 31 used for the semiconductor laser generates heat by light emission of its own, the higher the temperature at the time of light emission becomes, the milder the change in temperature due to the heat generation itself becomes, and the light-emitting power with respect to the driving current tends to be stabilized at a high value. On the other hand, the lower the temperature at the time of light emission is, the more intense the change in temperature due to heat generation becomes, and the light-emitting power with respect to the driving current tends to change rapidly. Thus, when the temperature of the semiconductor laser is high, even though it is set so that the automatic power control is performed at every scanning of a plurality of lines by lessening the frequency of the automatic power control, the light-emitting power of the laser chip 31 can be fully stabilized. On the other hand, since a change in temperature of the laser chip 31 becomes tense when the temperature of the laser chip 31 is low, the frequency of the automatic power control need to be increased to fully stabilize light-emitting power of the laser chip 31. Thus, the laser beam printer 1 of this embodiment is configured so that the temperature of the laser chip 31 is estimated based on the number of continuously-printed sheets within predetermined time and the ambient temperature of the photoconductive drum 2, and the frequency of the automatic power control is set according to the estimated temperature to control the laser driving circuit 33.

Figure 5:
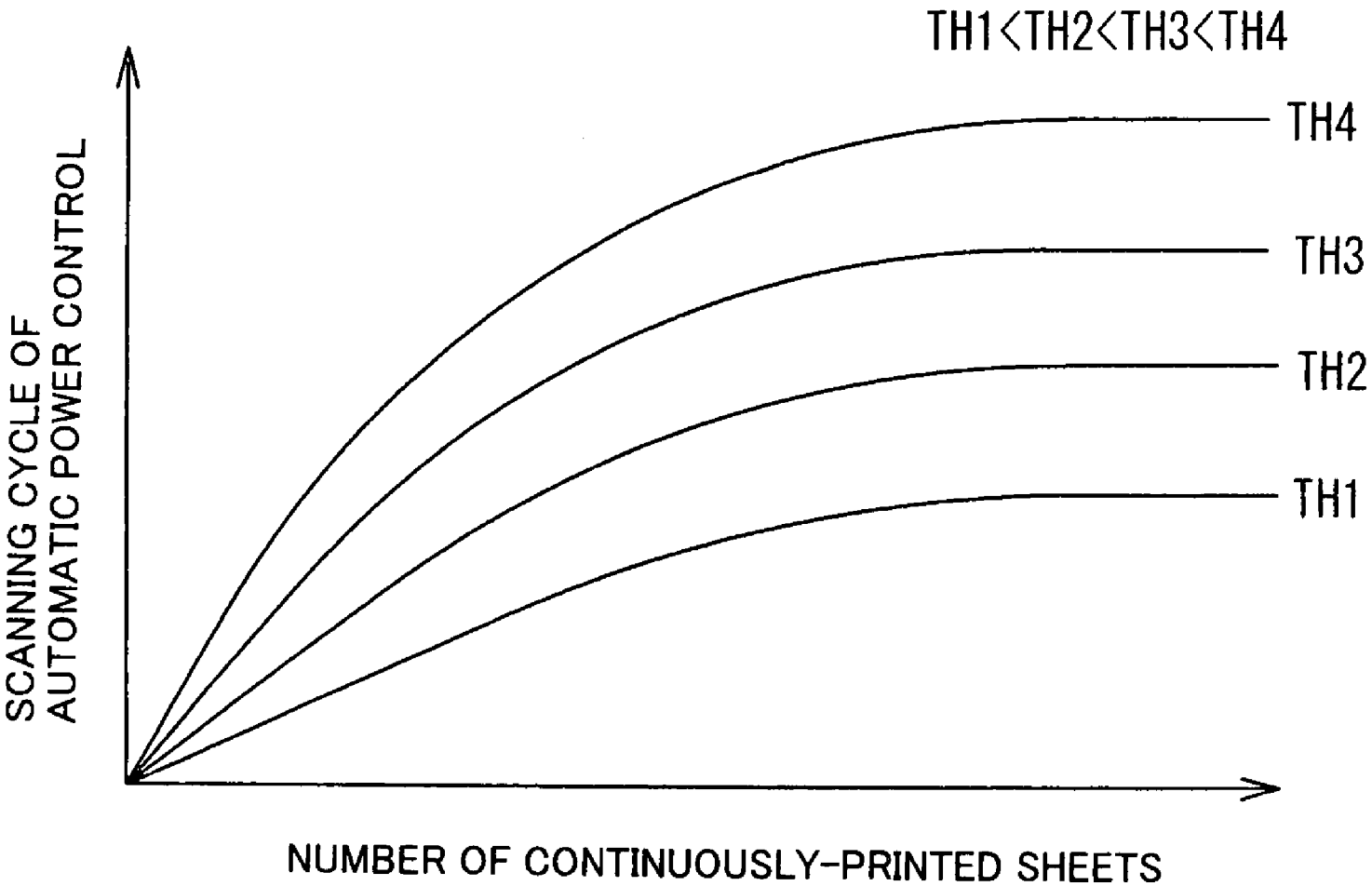
FIG. 5 is a graph showing relations between a number of continuously-printed sheets, and scanning cycle for performing the automatic power control at each ambient temperature of a photoconductive drum.

FIG. 5 shows an example of a relationship between the number of continuously-printed sheets and the scanning cycle for performing the automatic power control with respect to each ambient temperature of the photoconductive drum 2 detected by the temperature sensor 19. The control unit 12 stores this map and reduces the loads during printing by reducing the frequency of the automatic power control with due reference to the map. In FIG. 5, the ambient temperature of the photoconductive drum 2 becomes higher in the order of a temperature TH1, a temperature TH2, a temperature TH3 and a temperature TH4. In the laser beam printer 1, the scanning cycle for performing the automatic power control is set to be longer as the temperature detected by the temperature sensor 19 becomes higher by the control unit 12. On the other hand, following to the increase of the number of continuously-printed sheets, the scanning cycle for performing the automatic power control is set to become longer gradually, and when the number of printed sheets exceeds a predetermined value, the scanning cycle is set to be substantially constant. In this case, the increasing rate of the scanning cycle is not constant but is gradually decreased as the number of printed sheets is increased and becomes 0 finally.

Figure 6:
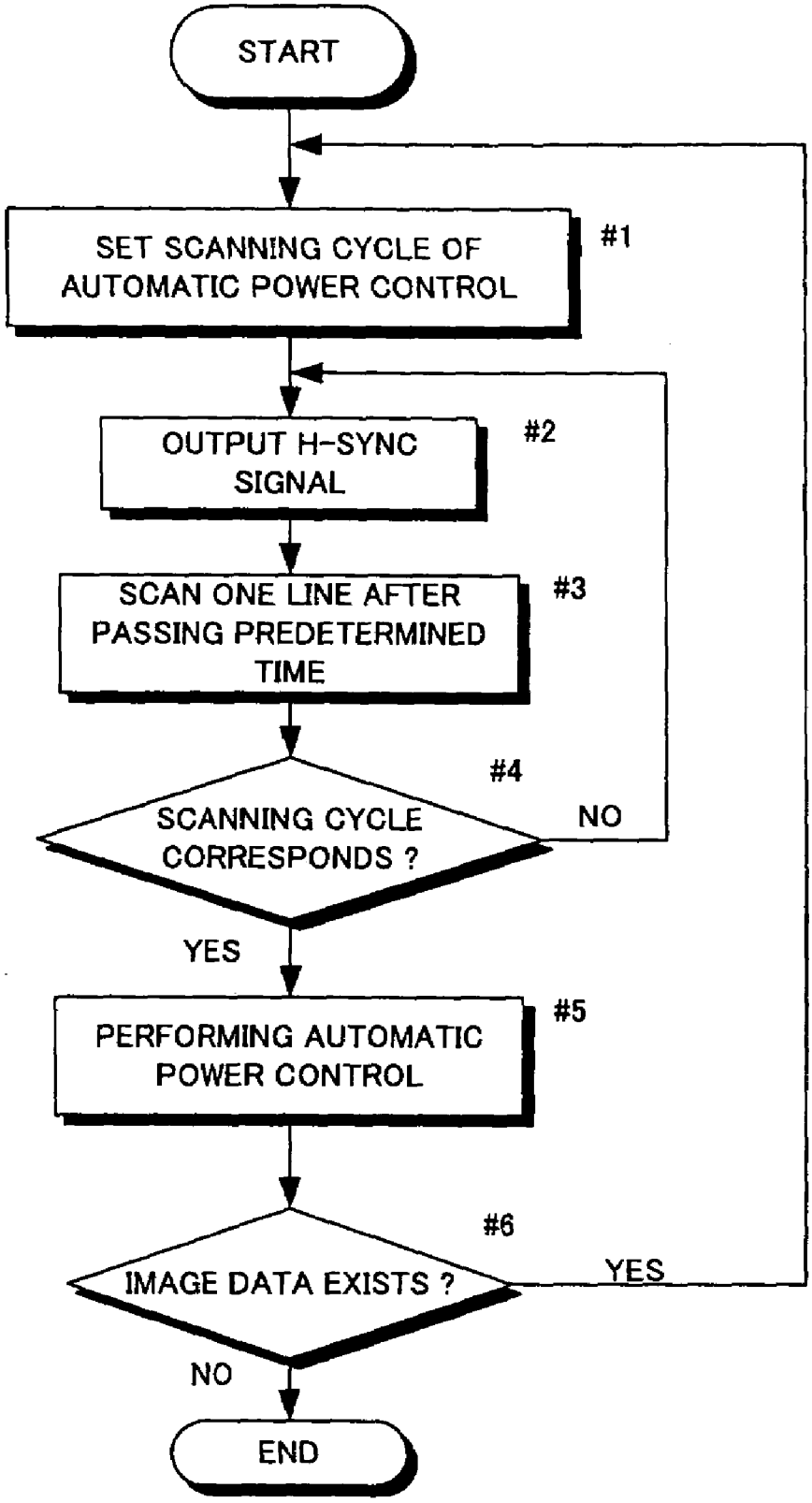
FIG. 6 is a flow chart showing an operation of the control unit during printing.

Subsequently, operation of the control unit 12 during printing will be described with reference to FIG. 6. First, the control unit 12 sets the scanning cycle for performing the automatic power control based on the ambient temperature of the photoconductive drum 2 detected by the temperature sensor 19 and the number of continuously-printed sheets (#1). Then, the control unit 12 outputs the horizontal synchronizing signal 62 to the laser driving circuit 33 (#2) and after passing a predetermined time, it outputs the image signal 61 for scanning of one line to the laser driving circuit 33, thereby causing the laser scan unit 5 to output the scanning laser beam (#3). When scanning in the step #3 corresponds to the scanning cycle set in the step #1 (YES in #4), the automatic power control is performed based on the output signal of the photodiode 32 (#5). When scanning in the step #3 does not correspond to the scanning cycle set in the step #1 (NO in #4), operation returns to the step #2 and the horizontal synchronizing signal 62 of the next line is output. When image data further exists after the automatic power control is performed in the step #5 (YES in #6), operation returns to the step #1. When no image data exists (NO in #6), processing is completed.

As described above, in the laser beam printer 1 of this embodiment, since the control unit 12 sets the scanning cycle for performing the automatic power control of the semiconductor laser based on the number of continuously-printed sheets within predetermined time and the ambient temperature of the photoconductive drum 2, and performs the automatic power control only when scanning of the laser scan unit 5 corresponds to the scanning cycle for performing the automatic power control, the loads applied to the control unit 12 can be reduced by decreasing the frequency of the automatic power control. Thus, an inexpensive CPU having low throughput capacity can be used as the control unit 12, thereby reducing manufacturing costs of the laser beam printer 1. The frequency of the automatic power control is lessened so as to perform the automatic power control every a few times of scanning when the temperature of the laser chip 31 laser is high, and the frequency of the automatic power control is increased to fully stabilize its light-emitting power when the temperature of the laser chip 31 is low. Thus, the laser driving circuit 33 can be rapidly followed in response to a sudden change in temperature of the laser chip 31 while reducing the loads applied to the control unit 12 as a whole, thereby stabilizing the light-emitting power of the laser chip 31.

The present invention is not limited to the configuration of the above-mentioned embodiment and can be modified variously. For example, the laser scan unit 5 can be applied various image forming apparatuses such as laser-scan type copying machines as well as the laser beam printer 1. Furthermore, the frequency of the automatic power control may be set based on the output of the temperature sensor 19 formed in the vicinity of the laser chip 31 for detecting the temperature of the laser chip 31.

An image forming apparatus of the present invention only needs to have a photoconductive drum on which a photoconductor is applied, a charging unit for uniformly charging the surface of the photoconductive drum, an exposing unit for irradiating and scanning a laser beam on the surface of the photoconductor to form a latent image, a developing unit for applying toner to a portion of the photoconductor on which the latent image is formed to form a toner image, a transfer unit disposed to face the surface of the photoconductive drum at a predetermined transfer position downstream of the developing unit in the rotation direction of the photoconductive drum for transferring the toner image formed on the surface of the photoconductive drum on recording paper sheet, a fixing unit for applying predetermined heat and pressure to the recording paper sheet on which the toner image is transferred to fix the toner image on the recording paper sheet, a control unit for controlling each of the units, and a temperature detecting unit for detecting ambient temperature of the photoconductive drum.

The exposing unit has a laser device including a light-emitting device for emitting a laser beam and a light receiving device for receiving a part of the laser beam emitted from the light-emitting device, converting the beam into an electric signal and outputting the electric signal to the control unit for the monitoring of the light-emitting device and a laser driving circuit for driving the laser device based on a current control signal output from the control unit.

The laser driving circuit receives the horizontal synchronizing signal output from the control unit at every scanning and then drives the light-emitting device according to the image signal output from the control unit after passing a predetermined time to expose the photoconductive drum.

After the exposing unit performs exposure of the photoconductive drum for scanning of one line and before the exposing unit outputs the horizontal synchronizing signal for next scanning to the laser driving circuit, the control unit performs the automatic power control of controlling the output by gradually increasing the level of the current control signal from a predetermined value, determining an optimum driving current for the light-emitting device based on the output value of the light-receiving device at this time and controlling the laser driving circuit.

When printing is continuously performed within predetermined time, the control unit calculates and stores the number of continuously-printed sheets and sets a scanning cycle for performing the automatic power control of the light-emitting device based on the stored number of continuously-printed sheets and the temperature detected by the temperature detecting unit.

The scanning cycle for performing the automatic power control is set to be longer as the temperature detected by the temperature detecting unit becomes higher, is set to be gradually longer as the number of continuously-printed sheets is increased and is set to be substantially constant when the number of printed sheets exceeds a predetermined value.

When scanning of the laser beam irradiated to the exposing unit corresponds to the scanning cycle for performing the automatic power control, the control unit performs the automatic power control and then, outputs the horizontal synchronizing signal and the image signal to the laser driving circuit and causes the laser driving circuit to drive the laser device to expose the photoconductive drum for scanning of one line. When scanning of the laser beam irradiated to the exposing unit does not correspond to the scanning cycle for performing the automatic power control, the control unit outputs the horizontal synchronizing signal and the image signal to the laser driving circuit and causes the laser driving circuit to drive the laser device to expose the photoconductive drum for scanning of one line without performing the automatic power control.

According to such configuration, since the control unit sets the scanning cycle for performing the automatic power control based on the number of continuously-printed sheets within predetermined time and the ambient temperature of the photoconductive drum and performs the automatic power control only when scanning of the laser beam irradiated to the exposing unit corresponds to the scanning cycle for performing the automatic power control, the loads applied to the control unit can be reduced by decreasing the frequency of the automatic power control. Thus, a cheap CPU having low throughput capacity can be used, thereby reducing manufacturing costs of the image forming apparatus.

The light-emitting device used in the laser device generates heat by light emission of its own. As the temperature becomes higher at the time of light emission, a change in temperature due to the heat generation becomes milder and the light-emitting power to the driving current tends to be stabilized at a high value. On the other hand, as the temperature at the time of light emission is lower, a change in temperature due to heat generation becomes more intense and light-emitting power to the driving current tends to change rapidly. Thus, when the temperature of the light-emitting device is high, even if it is set so that the automatic power control is performed every a few times of scanning by lessening the frequency of the automatic power control, light-emitting power of the laser chip 31 can be fully stabilized. On the other hand, when the temperature of the light-emitting device is low, the frequency of the automatic power control needs to be increased to fully stabilize light-emitting power of the light-emitting device. According to the present invention, since the temperature of the light-emitting device is estimated based on the number of continuously-printed sheets within predetermined time and the ambient temperature of the photoconductive drum and the frequency of the automatic power control is set according to the estimated temperature to control the laser driving circuit, the laser driving circuit can be rapidly followed in response to a sudden change in temperature of the light-emitting device while reducing the loads applied to the control unit as a whole, thereby stabilizing the light-emitting power of the light-emitting device.

This application is based on Japanese patent application 2004-318532 filed Nov. 1, 2004 in Japan, the contents of which are hereby incorporated by references.

Although the present invention has been fully described by way of example with reference to the accompanying drawings, it is to be understood that various changes and modifications will be apparent to those skilled in the art. Therefore, unless otherwise such changes and modifications depart from the scope of the present invention, they should be construed as being included therein.

What is claimed is:

1. An image forming apparatus comprising:

a photoconductive drum on which a photoconductor is applied;

a charging unit for uniformly charging a surface of the photoconductive drum;

an exposing unit for irradiating and scanning a laser beam on the surface of the photoconductor to form a latent image;

a developing unit for applying toner to a portion of the photoconductor on which the latent image is formed to form a toner image;

a transfer unit disposed to face the surface of the photoconductive drum at a predetermined transfer position downstream of the developing unit in a rotation direction of the photoconductive drum for transferring the toner image formed on the surface of the photoconductive drum to a recording paper sheet;

a fixing unit for applying predetermined heat and pressure to the recording paper sheet on which the toner image is transferred to fix the toner image on the recording paper sheet;

a control unit that performs an automatic power control of the light-emitting device, and counts and stores a number of continuously-printed sheets when printing is continuously performed within a predetermined time; and a temperature detecting unit for detecting ambient temperature of the photoconductive drum, wherein the control unit estimates a temperature of a laser chip based on the number of continuously-printed sheets within the predetermined time and the ambient temperature of the photoconductive drum, and sets a frequency of the automatic power control according to the estimated temperature of the laser chip and wherein the control unit performs the automatic power control at every scanning of one line when the ambient temperature of the photoconductor drum is lower than a predetermined value, and performs the automatic power control at each time after performing scanning of a plurality of lines when the ambient temperature of the photoconductor drum is equal to or higher than the predetermined value.

2. The image forming apparatus in accordance with claim 1, wherein the control unit sets a longer term as the scanning cycle of the automatic power control than a term previously set when the temperature detected by the temperature detecting unit increases.

3. The image forming apparatus in accordance with claim 1, wherein the control unit sets a longer term as the scanning cycle of the automatic power control than a term previously set when the number of continuously-printed sheets increases, and sets a constant value when the number of printed sheets exceeds a predetermined value.

* * * * *